US006457431B1

(12) United States Patent
Niskanen et al.

(10) Patent No.: US 6,457,431 B1
(45) Date of Patent: Oct. 1, 2002

(54) BALCONY ARRANGEMENT FOR A SHIP

(75) Inventors: Reijo Niskanen; Tapani Saarela, both of Vantaa (FI)

(73) Assignee: Kvaerner Masa-Yards Oy, Helsinki (FI)

( * ) Notice: Subject to any disclaimer, the term of this patent is extended or adjusted under 35 U.S.C. 154(b) by 0 days.

(21) Appl. No.: 09/718,314

(22) Filed: Nov. 21, 2000

(30) Foreign Application Priority Data

Nov. 22, 1999 (FI) ..... 992482

(51) Int. Cl.[7] ..... B63B 9/06
(52) U.S. Cl. ..... 114/65 R

(58) Field of Search ..... 114/65 R

(56) References Cited

U.S. PATENT DOCUMENTS 4,779,552 A 10/1988 Harsia et al. ..... 114/65 R
4,838,190 A * 6/1989 Levander ..... 114/189

* cited by examiner

*Primary Examiner*—Jesus D. Sotelo
(74) *Attorney, Agent, or Firm*—John Smith-Hill; Smith-Hill and Bedell

(57) ABSTRACT

A ship includes a space inward of its outer wall and provided with a balcony outward of the outer wall. The balcony has a load-bearing floor element supported by a bracket attached to the ship.

25 Claims, 4 Drawing Sheets

BALCONY ARRANGEMENT FOR A SHIP

BACKGROUND OF THE INVENTION

The subject of the invention is an arrangement for ship, specially for a passenger ship, in which there are spaces equipped with balconies, especially sequentially arranged cabins equipped with balconies.

It is known to provide a balcony on a ship so that the balcony is inside the frame of the ship, whereby the ship's outer wall (which forms an upward extension of the hull of the ship) also forms the outer wall of the balcony. This solution occupies a considerable amount of useful space inside the ship and additionally makes the maintenance of the balcony difficult. Another known solution is to fasten the balcony to the outer wall of the ship using a separate framework construction to which the balcony is attached and which supports the balcony. This solution for its part is complicated in construction and is also heavy.

The purpose of this invention is to provide an arrangement that avoids the above-mentioned disadvantages and with the help of which it is possible to install a balcony without difficulty and to provide a balcony of which the configuration can be modified to suit the location.

SUMMARY OF THE INVENTION

The arrangement according to the invention provides a balcony arranged at the actual outer wall of the ship and is light and simple and can be readily modified at the point of installation. The balcony includes a load-bearing floor element, which can easily be mounted on brackets or equivalent structures protruding from the ship. Other balcony features, which in practice are supported by the floor element, can be installed according to the desired balcony arrangement. The supporting brackets can for example be assembled to the extension of the bracing frame arcs, they can be attached to the outer wall of the ship, i.e. to the bodywork of the ship, at desired locations, for example by welding, or they can be arranged under the floor element before installation of the floor element and attached to the bodywork of the ship while installing the balcony.

Supporting pillars may be provided at least between adjoining balconies, i.e. between adjacent sections of balcony that are divided to form separate balconies. The pillar is supported at its lower end by the load-bearing floor element. In the event that there are two or more tiers or rows of balconies, one above the other, the supporting pillar of a lower balcony may be supported at its upper end by, for example, the supporting bracket situated above the lower balcony.

The supporting pillar may be hollow, in which case it can form part of a drainage system for collecting and removing water so that it is not necessary to provide extra elements for this purpose. Then it is advantageous to provide the floor element with a trough element to lead the water in a desired way. The floor element is advantageously provided with a lead-in, which connects the trough element to the supporting pillar to guide the water away from the balcony. The lead-in can for example be of a funnel-shaped construction to secure the guiding of the water.

If there are several tiers of balconies one above the other, the lead-in associated with the floor element of an upper balcony is arranged advantageously to debouch into a supporting pillar of a lower balcony, whereby at least the overlapping balconies can be connected to the same drainage system.

The balcony is equipped advantageously with a rail (a barrier surmounted by a hand rail), which is supported by the outer edge of the floor element and by at least one and preferably two supporting pillars. In this case, the outer edge of the floor element is advantageously equipped with a fitting element, which forms both the trough element and a receiving element for the rail. To provide separation of balconies from each other one an arrange a wall element between adjacent balconies. The all element is advantageously supported at one edge by the supporting pillar and at the other edge by the outer wall of the ship or an outer wall of a cabin. The wall element is advantageously in the form of a door, which enables passage from one balcony to another. This is a considerable advantage with respect to, for example, rationalizing the cleaning work. Additionally, it allows a combined or common balcony, for example for two adjoining cabins.

The load-bearing floor element is advantageously of a composite construction including two outer surface elements, which are fabricated for example from aluminum, and between them a honeycomb element. This kind of structure makes the floor element light, but still able to withstand a substantial load.

BRIEF DESCRIPTION OF THE DRAWINGS

In the following the invention is described by way of example with reference to the attached drawings, wherein.

DETAILED DESCRIPTION

Figure 1:
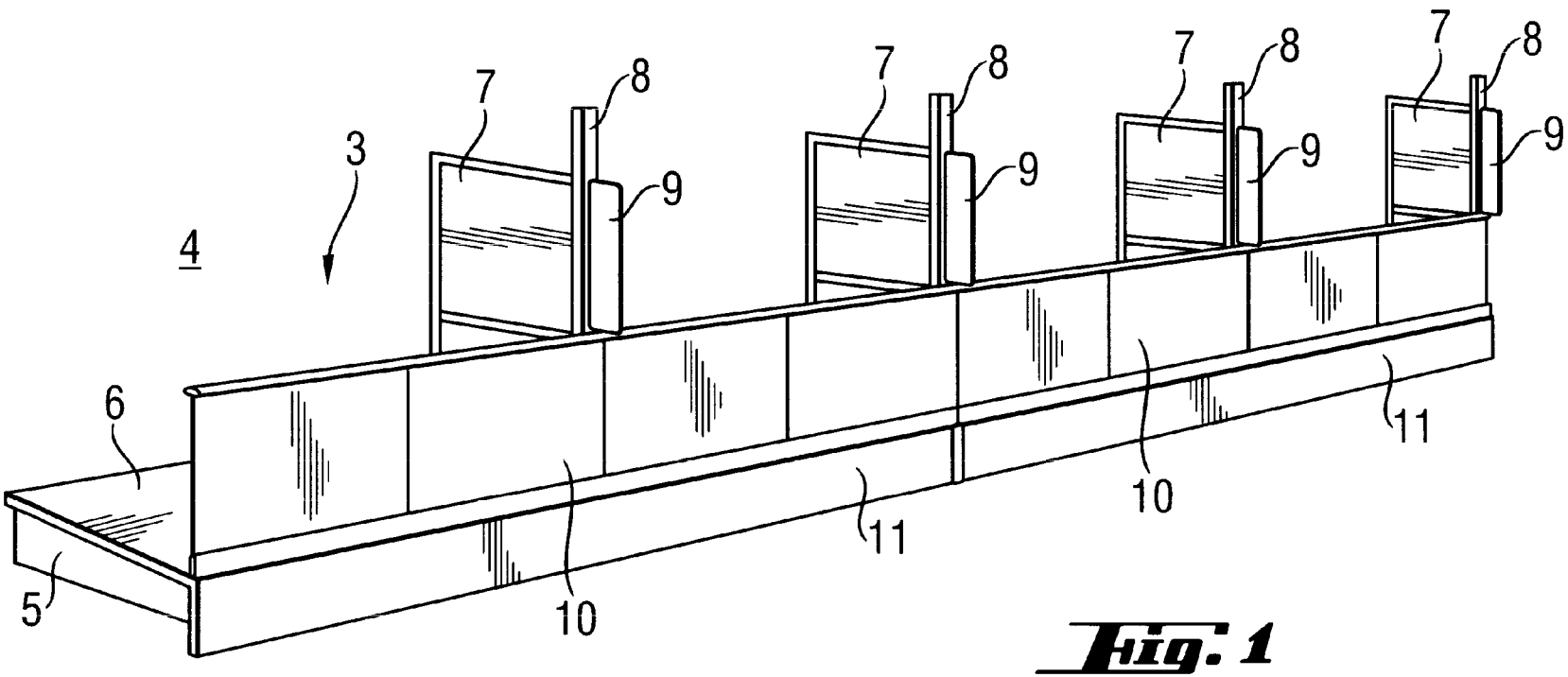
FIG. 1 is a perspective view of a balcony arrangement for a passenger ship.
Figure 2:
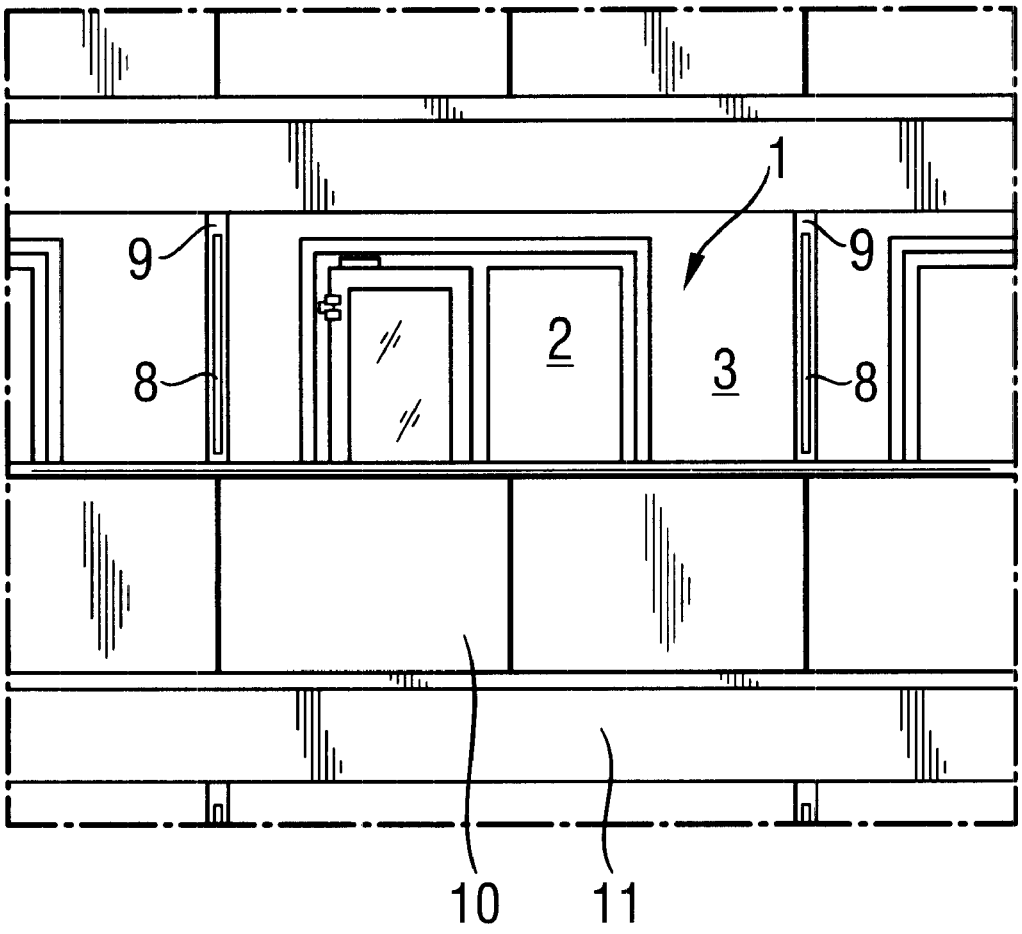
FIG. 2 is a front elevation of the balcony arrangement.

In FIG. 1 the reference 6 shows a load-bearing structural element of a balcony arrangement according to the invention, in particular a floor element. In FIG. 2 the reference 1 shows a cabin, whose door 2 opens to a balcony 3. The floor element 6 is attached to the frame of the ship, or to a supporting bracket 5 fastened to the outer wall 4 of the ship, or to another like construction. Adjacent balconies 3 are separated from each other by a wall element 7, which is supported on the one hand by the outer wall 4 of the ship and on the other hand by a supporting pillar 8. Protecting plates 9, which mainly provide a visual obstruction from one balcony to another, are also attached to the supporting pillars 8. In addition the balconies are equipped with a rail 10 and a downwards extending protecting plate 11, which improves the exterior appearance of the balcony arrangement by concealing the supporting brackets 5. The protecting plate 11 also shields those on the balcony from view and thus provides increased privacy.

Figure 3:
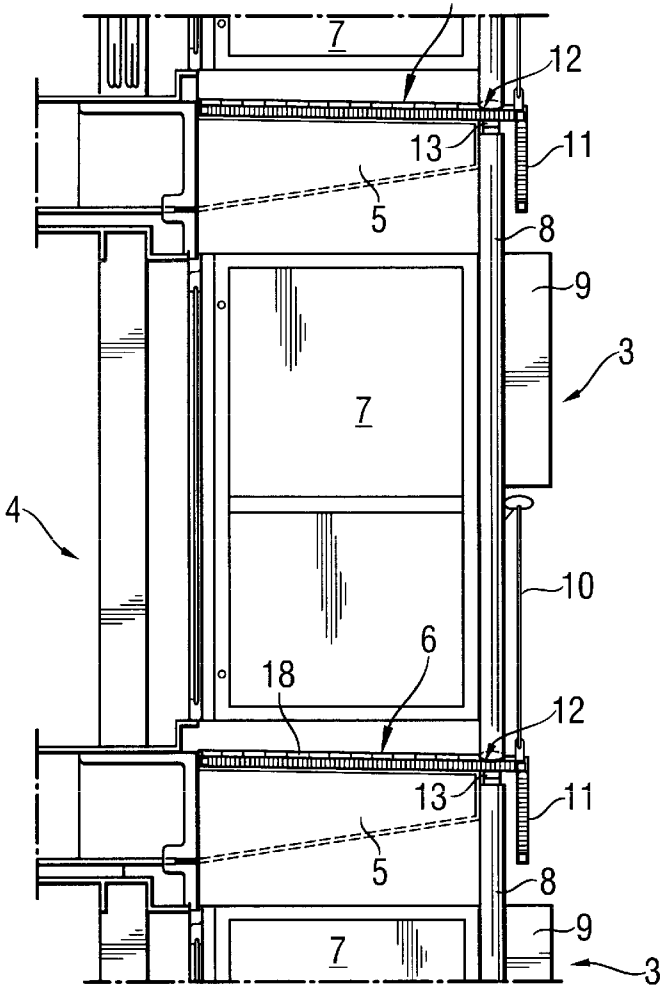
FIG. 3 is a sectional view of a first balcony arrangement in accordance with the invention.

FIG. 3 shows more details of an implementation of the balcony arrangement and illustrates an intermediate balcony arrangement and parts of upper and lower balcony arrangements. The floor element 6 of the intermediate balcony 3 is supported by the supporting bracket 5, which is fastened to the outer wall 4 of the ship and can be for example a steel T-profile. The supporting pillar 8 is supported at its lower end by the floor element 6 and at its upper end by the supporting bracket 5 of the floor element 6 of the upper balcony 3. The supporting pillar 8 could alternatively be supported at its upper end by the floor element 6 of the upper balcony or by the protecting plate 11. The mode of bracing can be chosen according to the desired balcony arrangement.

The supporting pillar 8 is hollow, which allows it to be used as part of the drainage system, for example for removal of rainwater. The drainage system also includes a flume or channel 12 (FIG. 5), which extends along the outer edge of the floor element 6 and is connected advantageously at its ends to the hollow interior of a supporting pillar 8. An inlet 13 of the drainage system is provided at the connection of the supporting pillar 8 and the flume 12 and extends through the floor element 6 and discharges into the hollow supporting pillar 8 of the lower balcony 3 to guide the water from one balcony to another. The inlet 13 itself may be funnel shaped to secure the guiding of the water. Alternatively the lower end of the supporting pillar 8 may be of funnel shaped construction at its interior.

The balcony 3 is equipped with a rail 10, which is supported at the outer edge of the floor element 6 and at the supporting pillar 8. In the illustrated embodiment the hand rail is attached to the supporting pillar 8.

Figure 5:
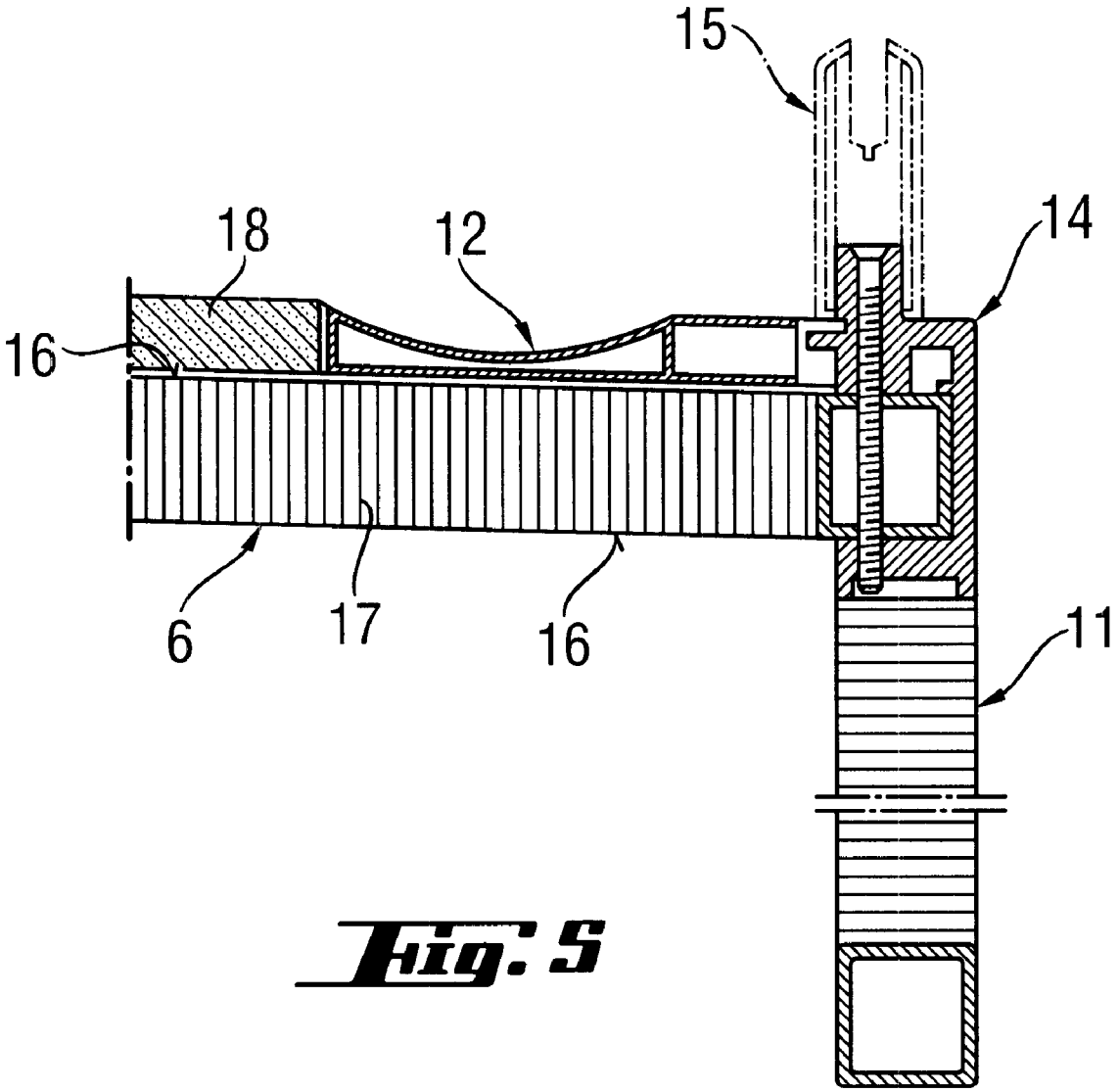
FIG. 5 is a sectional view of a detail of the balcony arrangement.

The floor element 6 is equipped with a fitting element 14 which is shown in more detail in FIG. 5. The fitting element 14 is attached to the outer edge of the floor element 6 and consists of the protecting plate 11, a receiving element 15 engaged by the lower edge of the rail, and the flume 12. The receiving element 15 is in this embodiment a profile element. The form and construction of the receiving element can however vary according to each balcony arrangement. The basis is that a simple but multifunctional component attached to the floor element 6 supports the rail, forms a part of the drainage arrangement, and is part of the protective arrangement of the balcony. The fitting element 14 may also support the pillar 8. FIG. 5 also shows how the fitting element 14 can act as a bolt element or as a support element for a floor covering or decking 18 of the balcony, for example for planking. The floor element 6 is of a composite construction and consists of two outer surface elements 16, which for example can be aluminum, and between them a honeycomb element 17. The covering plate 11 of the fitting element 14 may be of similar composite construction The balcony arrangement comprises also the wall element 7 between balconies 3. One upright edge of the wall element 7 is supported by the supporting pillar 8 and its other upright edge is supported by the outer wall 4 of the ship or by the outer wall of the cabin. The supporting pillar 8 and the outer wall 4 provide a frame around the wall element. The wall element 7 advantageously includes a door to enable passage from one balcony to the adjacent balcony.

Figure 4:
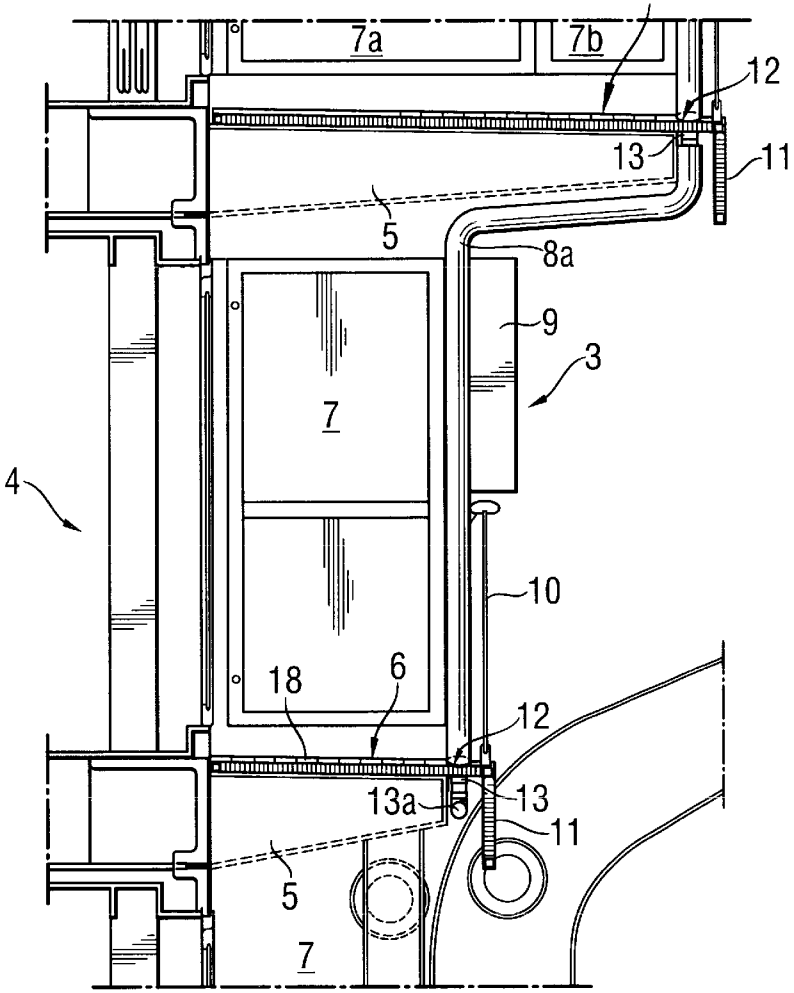
FIG. 4 is a sectional view of a second balcony arrangement in accordance with the invention.

The embodiment shown in FIG. 4 is mainly equivalent to the embodiment shown in FIG. 3. FIG. 4 shows the intermediate balcony 3 narrower than the upper balcony 3 in order to accommodate a lifeboat davit 19. The upper portion of the supporting pillar 8*a* includes an S bend so that it fits the positions required by both the upper and lower balconies. The lower supporting bracket 5 is shorter than the upper supporting bracket. Additionally, since there is no balcony below the narrower balcony, the inlet 13 is provided with a discharge opening 13*a*, which can be connected for example to a water collection system included in the hpac (heating, plumbing, air conditioning) system of the ship. This embodiment is a good indication of how easily one can adapt the arrangement according to the invention to each installation location, in this case according to the narrower balcony 2 required at the location of the lifeboat davit 19. Additionally, in the figure the upper wall element is in two panels 7*a*, 7*b*.

The above described balcony arrangement, which comprises a load-bearing floor element and accessory parts assembled thereto, forms an independent or self-contained construction module, which can be made for example two or four cabin units in length. The module can be prefabricated and fastened to the body or frame of the ship employing support elements previously attached to the ship, or the support elements can be included in the balcony module itself. It will be understood that, for example in big passenger ships, where the number of cabins can be about one thousand and the aim is to maximize the number of balcony cabins, this simplifies and expedites the building of the ship. The balcony arrangement can be made very light, by virtue for example of the composite floor element and the small number of mounting structures compared to the known balcony arrangements, whereby one achieves a significant reduction in weight. The reduction in weight that can be achieved is in the region of about 30–120 tons, which is of considerable importance since the balconies normally are situated on the upper decks of the ship and a reduction in weight of the balconies serves to improve the stability of the ship.

Although the invention has been described in connection with a passenger ship including cabins provided with balconies, it will be understood that the invention is applicable to other types of ships and/or to the balconies being arranged together with another space, for example together with restaurant space or living space.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. A ship including a space provided with a balcony having a load-bearing floor element, the floor element being supported by a bracket attached to the ship, the balcony being equipped with a rail that is supported by an outer edge of the floor element, and wherein the balcony comprises a fitting element including a trough element extending along the outer edge of the floor element and a receiving element for engagement by the rail.

2. A ship according to claim 1, wherein the floor element of the balcony is formed with a channel, the channel forming part of a drainage system for removal of rainwater, and wherein the channel is connected to an inlet element that passes through the floor element of the balcony.

3. A ship according to claim 2, further including a hollow support pillar below the balcony and wherein the inlet element extends into said hollow support pillar.

4. A ship according to claim 1, wherein the fitting element includes a protecting plate.

5. A ship according to claim 1, wherein the balcony has two opposite ends and a support pillar is located between the ends of the balcony, and the ship further comprises a wall element which is attached at one edge to the support pillar and at an opposite edge to an outer wall of the ship or an outer wall of a cabin.

6. A ship according to claim 5, wherein the wall element includes a door.

7. A ship provided with upper and lower balconies each having a load-bearing floor element, the floor elements being supported by brackets attached to the ship, and wherein the ship further includes an upper hollow support pillar supported at a lower end by the floor element of the lower balcony and at an upper end by the upper balcony and a lower hollow support pillar below the lower balcony, and wherein the floor element of the lower balcony is formed with a channel, the channel and the upper hollow support pillar each forming part of a drainage system for removal of rainwater, and wherein the channel and the hollow interior of the upper support pillar are connected to an inlet element that passes through the floor element of the lower balcony and extends into said lower hollow support pillar.

8. A ship according to claim 7, wherein the lower balcony is equipped with a rail, which is supported by an outer edge of the floor element and by the upper support pillar.

9. A ship having an outer wall and including at least one tier containing at least two cabins inward of the outer wall and adjacent one another, the ship comprising:

brackets projecting outward of the outer wall, and a continuous load-bearing floor element outward of the outer wall, the floor element being supported by the brackets and extending adjacent said cabins and providing balconies for said cabins.

10. A ship according to claim 9, wherein the floor element is formed with a channel, the channel forming part of a drainage system for removal of rainwater, and wherein the channel is connected to an inlet element that passes through the floor element.

11. A ship according to claim 10, further including a hollow support pillar below the floor element and wherein the inlet element extends into said hollow support pillar.

12. A ship according to claim 7, wherein the balconies are equipped with a rail that is supported by an outer edge of the floor element.

13. A ship according to claim 12, wherein the balconies comprise a fitting element including a trough element extending along the outer edge of the floor element and a receiving element for engagement by the rail.

14. A ship according to claim 13, wherein the fitting element includes a protecting plate.

15. A ship according to claim 9, wherein the floor element has two opposite ends and a support pillar is located between the ends of the floor element, and the ship further comprises a wall element which is attached at one edge to the support pillar and at an opposite edge to the outer wall of the ship or an outer wall of a cabin.

16. A ship according to claim 15, wherein the wall element includes a door.

17. A ship according to claim 9, wherein the load-bearing floor element is of composite construction and comprises two outer surface elements and a honeycomb element therebetween.

18. A ship having an outer wall and including at least upper and lower tiers each containing at least two cabins inward of the outer wall and adjacent one another, the ship comprising:

brackets projecting outward of the outer wall, an upper continuous load-bearing floor element outward of the outer wall, the upper floor element being supported by the brackets and extending adjacent said cabins of the upper tier and providing balconies for said cabins of the upper tier, a lower continuous load-bearing floor element outward of the outer wall, the lower floor element being supported by the brackets and extending adjacent said cabins of the lower tier and providing balconies for said cabins of the lower tier, and a support pillar supported at a lower end by the lower floor element and at an upper end by the upper floor element.

19. A ship according to claim 18, wherein the support pillar is hollow and the lower floor element is formed with a channel, the channel and the hollow support pillar each forming part of a drainage system for removal of rainwater, and wherein the channel and the hollow interior of the support pillar are connected to an inlet element that passes through the lower floor element.

20. A ship according to claim 19, further including a hollow support pillar below the lower floor element and wherein the inlet element extends into said hollow support pillar.

21. A ship according to claim 18, wherein the balconies of the lower cabins are equipped with a rail, which is supported by an outer edge of the lower floor element and by the support pillar.

22. A ship according to claim 21, wherein the balconies of the lower cabins comprise a fitting element which includes a trough element extending along the outer edge of the lower floor element and a receiving element for engagement by the rail.

23. A ship according to claim 22, wherein the fitting element includes a protecting plate.

24. A ship according to claim 18, wherein the lower floor element has two opposite ends and the support pillar is located between the ends of the lower floor element, and the ship further comprises a wall element which is attached at one edge to the support pillar and at an opposite edge to the outer wall of the ship or an outer wall of a cabin.

25. A ship according to claim 24, wherein the wall element includes a door.

* * * * *

UNITED STATES PATENT AND TRADEMARK OFFICE

CERTIFICATE OF CORRECTION

PATENT NO. : 6,457,431 B1
DATED : October 1, 2002
INVENTOR(S) : Reijo Niskanen and Tapani Saarela It is certified that error appears in the above-identified patent and that said Letters Patent is hereby corrected as shown below:

Column 5,
Line 32, "7" should be deleted and replaced with -- 9 --.

Signed and Sealed this

Eighteenth Day of February, 2003

JAMES E. ROGAN
*Director of the United States Patent and Trademark Office*